US006419019B1

(12) United States Patent
Palmer et al.

(10) Patent No.: US 6,419,019 B1
(45) **Date of Patent: *Jul. 16, 2002**

(54) METHOD TO REMOVE PARTICULATE MATTER FROM A WELLBORE USING TRANSLOCATING FIBERS AND/OR PLATELETS

(75) Inventors: Bentley J. Palmer, Missouri City; Dean M. Willberg, Sugar Land, both of TX (US); Roger J. Card, Paris (FR); J. Ernest Brown, Katy; Philip F. Sullivan, Bellaire, both of TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/196,277

(22) Filed: Nov. 19, 1998

(51) Int. Cl.[7] ..... E21B 37/00

(52) U.S. Cl. ..... 166/311; 166/304; 175/65; 507/219; 507/117

(58) Field of Search ..... 507/219, 117; 175/65; 166/311, 304, 312

(56) References Cited

U.S. PATENT DOCUMENTS

| | | | | |
|---|---|---|---|---|
| 2,756,209 A | | 7/1956 | Morgan | 507/104 |
| 2,811,488 A | | 10/1957 | Nestle et al. | 507/104 |
| 2,944,019 A | * | 7/1960 | Thompson | 175/65 |
| 3,046,222 A | | 7/1962 | Phansalkar et al. | 166/283 |
| 3,174,561 A | * | 3/1965 | Sterrett et al. | 175/65 |
| 3,409,499 A | | 11/1968 | Dresher et al. | 162/3 |
| 3,593,798 A | | 7/1971 | Darley | 166/295 |
| 3,601,194 A | | 8/1971 | Gallus | 166/283 |
| 3,692,125 A | * | 9/1972 | Ruhle | 175/65 |
| 3,694,308 A | | 9/1972 | Botz | 162/55 |
| 3,774,683 A | | 11/1973 | Smith et al. | 166/293 |
| 3,854,533 A | | 12/1974 | Gurley et al. | 166/276 |
| 3,891,565 A | | 6/1975 | Colpoys | 507/269 |
| 3,973,627 A | | 8/1976 | Hardy et al. | 166/276 |
| 4,160,755 A | | 7/1979 | Choe et al. | 524/251 |

(List continued on next page.)

FOREIGN PATENT DOCUMENTS

| | | |
|---|---|---|
| GB | 2169018 A | 7/1986 |
| WO | WO 93/01333 | 1/1993 |
| WO | WO 93/1928 | 9/1993 |

OTHER PUBLICATIONS

Lisa A. Cantu & Phil A. Boyd, "Laboratory and Field Evaluation of a Combined Fluid–Loss–Control Additive and Gel Breaker for Fracturing Fluids," *SPE Production Engineering,* pp. 253–260,Aug. 1990.

A. Gyr and H. W. Bewersdorff, "Drag Reduction in Fibre– and Non–Fibrous Suspensions", *Drag Reduction of Turbulent Flows by Additives,* pp. 175–190 (1995).

Gray et al, "Composition and Properties of Oil Well Drilling Fluids", pp. 579–582 (1980).

Joseph S. Hayes, Jr., "Kynol Novoloid Fibers in Friction and Sealing Materials", *American Kynol, Inc.,* pp. 1–2 (1981).

(List continued on next page.)

*Primary Examiner*—David Bagnell
*Assistant Examiner*—Jennifer R. Dougherty
(74) *Attorney, Agent, or Firm*—Robin C. Nava; Stephen F. Schlather; Thomas O. Mitchell

(57) ABSTRACT

An improved method for transport of particulate matter in a wellbore fluid, and particularly the transport of particulate matter in subterranean wells, such as hydrocarbon wells, is disclosed, the method being characterized by utilization of specified fibers to aid in transport of the particulate matter. Additional embodiments include the removal of particulate matter (particles) and particle deposits, such as from drill cuttings, during the drilling of wells, and the removal of particulate matter deposits in cleanout operations.

18 Claims, 4 Drawing Sheets

U.S. PATENT DOCUMENTS

| | | | | | |
|---|---|---|---|---|---|
| 4,173,999 | A | | 11/1979 | Messenger | 166/293 |
| 4,272,495 | A | | 6/1981 | Stewart et al. | 423/167.1 |
| 4,284,538 | A | | 8/1981 | Graham | 524/147 |
| 4,289,632 | A | | 9/1981 | Clear | 507/104 |
| 4,330,337 | A | | 5/1982 | Graham | 106/151.2 |
| 4,330,414 | A | | 5/1982 | Hoover | 507/114 |
| 4,361,465 | A | | 11/1982 | Graham | 162/156 |
| 4,370,169 | A | | 1/1983 | Graham | 106/267 |
| 4,381,199 | A | | 4/1983 | Graham | 162/165 |
| 4,392,964 | A | | 7/1983 | House et al. | 507/114 |
| 4,428,843 | A | | 1/1984 | Cowan et al. | 507/106 |
| 4,439,328 | A | | 3/1984 | Moity | 507/204 |
| 4,526,240 | A | | 7/1985 | McKinley et al. | 175/72 |
| 4,527,627 | A | | 7/1985 | Graham et al. | 166/280 |
| 4,605,329 | A | | 8/1986 | Duffy | 406/49 |
| 4,708,206 | A | | 11/1987 | Jennings Jr. | 166/281 |
| 4,871,284 | A | | 10/1989 | Duffy | 406/49 |
| 4,875,525 | A | | 10/1989 | Mana | 166/280 |
| 5,222,558 | A | | 6/1993 | Montgomery et al. | 166/278 |
| 5,251,697 | A | | 10/1993 | Shuler | 166/268 |
| 5,330,005 | A | | 7/1994 | Card et al. | 166/280 |
| 5,354,456 | A | | 10/1994 | Montgomery et al. | 210/170 |
| 5,377,760 | A | | 1/1995 | Merrill | 166/295 |
| 5,439,055 | A | | 8/1995 | Card et al. | 166/280 |
| 5,501,274 | A | | 3/1996 | Nguyen et al. | 166/276 |
| 5,501,275 | A | | 3/1996 | Card et al. | 166/280 |
| 5,551,514 | A | | 9/1996 | Nelson et al. | 166/280 |
| 5,582,249 | A | | 12/1996 | Caveny et al. | 166/276 |
| 5,591,699 | A | | 1/1997 | Hodge | 507/213 |
| 5,597,784 | A | | 1/1997 | Sinclair et al. | 507/219 |
| 5,652,058 | A | | 7/1997 | Nagata et al. | 428/378 |
| 5,679,149 | A | | 10/1997 | Tezuka et al. | 106/644 |
| 5,685,902 | A | | 11/1997 | Tezuka et al. | 106/643 |
| 5,839,520 | A | * | 11/1998 | Maillet | 175/61 |
| 6,016,872 | A | * | 1/2000 | Davis | 166/312 |
| 6,085,844 | A | * | 7/2000 | Palmer et al. | 166/312 |
| 6,164,380 | A | | 12/2000 | Davis | 166/312 |

OTHER PUBLICATIONS

Simon G. James, Michael L. Samuelson, Glenn W. Reed, Steven C. Sullivan, "Proppant Flowback Control in High Temperature Wells", *SPE 39960,* pp. 1–7 (Apr., 1998).

Minthorn & Garvin, "Successful Application of New Technology in Antrim Shale Completions", *SPE 23421,* pp. 71–76 (1991).

Hiroshi Mizunuma & Horishi KATO, "Frictional Resistance in Fiber Suspensions", *Bulletin of the JSME,* vol. 26, #219, pp. 1567–1574, Sep. 1983.

C. A. Parker & A. H. Hedley, "A Structural Basis for Drag–Reducing Agents", *Journal of Applied Polymer Science,* vol. 18, pp. 3403–3421, 1974.

M. T. Thew & J. S. Anand, "Characterising Asbestos Fibres Suitable For Drag Reduction", International Conference on Drag Reduction, paper D2–15–30, Sep., 1974.

R.S. Sharma, V. Seshadri, R. C. Malhotra, "Drag Reduction by Centre–Line Injection of Fibres in a Polymeric Solution", *The Chemical Engineering Journal,* vol. 18, pp. 73–79, 1979.

R.S. Sharma, V. Seshadri, R. C. Malhotra, "Drag Reduction in Dilute Fibre Suspensions: Some Mechanistic Aspects", *Chemical Engineering Science,* vol. 34, pp. 703–713, 1979.

J. P. Malhotra, S. R. Deshmukh, R. P. Singh, "Turbulent Drag Reduction by Polymer–Fiber Mixtures", *Journal of Applied Polymer Science,* vol. 33, pp. 2467–2478, 1987.

G. V. Reddy, R. P. Singh, "Drag reduction effectiveness and shear stability of polymer–polymer and polymer–fibre mixtures in recirculatory turbulent flow of water", *Rheol Acta,* 24 pp. 296–311, 1985.

P. F. W. Lee & G. G. Duffy, "An analysis of the drag reducing regime of pulp suspension flow", *Tappi,* vol. 59, #8, pp. 119–122, Aug., 1976.

Gunnar Hemstrom, Klaus Moller, Bo Norman, "Boundary layer studies in pulp suspension flow", *Tappi,* vol. 59, #8, 115–118, Aug., 1976.

"Mechanism of Drag Reduction in Turbulent Pipe Flow by the Addition of Fibers", *Ind. Eng. Chem. Fundam,* vol. 20, pp. 101–102, 1981.

I. Radin, J. L. Zakin, G. K. Patterson, "Drag Reduction in Solid–Fluid Systems", *AIChE Journal,* vol. 21, #2, pp. 358–371, Mar., 1975.

D. D. Kale and A. B. Metzner, "Turbulent Drag Reduction in Fiber–Polymer Systems: Specificity Considerations", *AIChE Journal,* vol. 20, #6, pp. 1218–1219, Nov., 1974.

Peter F. W. Lee and Geoffrey G. Duffy, "Relationships Between Velocity Profiles and Drag Reduction in Turbulent Fiber Suspension Flow", *AIChE Journal,* vol. 22, #4, pp. 750–753, Jul., 1976.

"Drag Reduction in the Turbulent Flow of Fiber Suspensions", *AIChE Journal,* vol. 20, #2, pp. 301–306, Mar., 1974.

W. K. Lee, R. C. Vaseleski and A. B. Metzner, "Turbulent Drag Reduction in Polymeric Solutions Containing Suspended Fibers", *AIChE Journal,* vol. 20, #1, pp. 128–133, Jan., 1974.

Arthur B. Metzner, "Polymer solution and fiber suspensions rheology and their relationship to turbulent drag reduction", *The Physics of Fluids,* vol. 20, #10, PT 11, pp. S5145–149, Oct., 1977.

W. D. McComb & K. T. J. Chan, "Drag reduction in fibre suspensions: transitional behaviour due to the fibre degradation", *Nature,* vol. 280, pp. 45–46, Jul., 1979.

W. D. McComb & K. T. J. Chan, "Drag reduction in fibre suspension", *Nature,* vol. 292, pp. 520–522, Aug., 1981.

J. G. Savins, "Drag reducing additives improve drilling fluid hydraulics", *Oil & Gas Journal,* pp. 79–86, Mar. 13, 1995.

"Effective Remediation of Lost Circulation Slot Sealing Test Results", *Montello Pheno Seal Publication,* pp. 1–3, 1997.

Aston, M.S., "Techniques for Solving Torque and Drag Problems in Today's Drilling Environment", SPE Article 48939, BP Exploration, Sunbury, England, pp. 55–68 (1998).

Kelco Oil Field Group, "Microfibrous Cellulose", Development Product Bulletin, Mar. 1997.

4$^{th}$ Annu Petrol Network Educ Conf (Pnec) Emerging Technol Int Conf (Aberdeen, Scot, 96.06.05.–06) Proc. PAP No. 16, 1996 (Abs.).

Amer Chem Soc Polymeric Matter Sci Eng Div Tech Program (Anaheim, Calif, 86.09.07–12) Proc. (192$^{nd}$ Acs Nat Mtg) V 55, pp. 880–888, 1986 (ISBN 0–8412–0985–5;4 Refs) (Abs.).

Encyclopedia of Chemical Technology (Kirk–Othmer) (Third Edition) 1980, pp. 148–197.

P. R. Howard, M. T. King, M. Morris, J–P Feraud, G. Slusher, and S. Lipari, "Fiber/Proppant Mixtures Control Proppant Flowback in South Texas", SPE 30495, pp. 1–12, Oct., 1995.

* cited by examiner

METHOD TO REMOVE PARTICULATE MATTER FROM A WELLBORE USING TRANSLOCATING FIBERS AND/OR PLATELETS

FIELD OF THE INVENTION

The invention relates to the improved transport of particulate matter in a wellbore fluid, and particularly concerns the transport of particulate matter in subterranean wells, particularly hydrocarbon wells. The invention especially concerns the removal of particles and particle deposits, such as from drill cuttings, during the drilling of wells, and to the removal of particulate matter deposits in cleanout operations.

BACKGROUND OF THE INVENTION

Deposition of particulate material in a wellbore, from sources such as formation cuttings or particles transported from a loose structure or fracture, can pose significant problems in the drilling of a well or in subsequent wellbore operations. For example, the deposition of such particles between the drillstring or a coilable drill tubing and the wellbore wall during drilling can interfere with fluid circulation, thereby increasing pumping costs and possibly clogging the wellbore. Again, later-occurring particulate deposits, such as may occur during production of a hydrocarbon fluid, can also clog a wellbore and reduce the rate of production from the well.

While deposition of particulate matter may occur in drilling any wellbore, including vertically drilled wellbores, particulate deposition is a more frequent concern in directional drilling of so-called "deviated" or curved wellbores. The deviated wellbore may be drilled utilizing conventional drillstring techniques and equipment, or the well may be drilled by specialized tools which are not rotated from the surface but which rely on rotational means positioned downhole. In both instances, as in standard vertical drilling, the drill bit utilized is supplied with a fluid or "mud" for lubrication and for removal of formation cuttings as the drilling proceeds. With conventional equipment, the drilling fluid or mud is circulated down the interior of the rotating drill pipe, through and/or around the drill bit, and back up the wellbore to the surface in the annulus formed between the exterior of the drillpipe and the wall of the wellbore. In operations utilizing a downhole driving source, the drilling fluid is commonly sent downhole through a coilable thinner tubing (commonly referred to in the art as coiled tubing) which does not rotate, perhaps through the driving source, and then through and/or around the bit, cuttings and fluid being returned up the wellbore through the wellbore annulus or space between the coiled tubing and the wall of the wellbore.

In both types of operations, i.e., whether with standard equipment or with coiled tubing, the deviated wellbore, with its horizontal component and bends, provides surface locations or sites which are especially susceptible to the deposition of particulate matter, e.g., the cuttings present in drilling fluid, or proppant migrating from a fracture. While drilling fluid pressure is normally sufficient to prevent complete clogging of the well during drilling operations, the resulting increased pressure drop due to the reduced size of the fluid return path represents, as indicated, a significant penalty in terms of pumping requirements. Coiled tubing operations are particularly troubled by particulate deposits because the normal drillstring rotation which tends to keep particles in suspension is not present and the use of the thinner diameter tubing provides extra space in the wellbore for such deposits. In addition, during production operations from a completed well, particle transport from a loose subterranean structure, or even proppant flowback from a fracture, can result in deposits which may block or reduce product flow and ultimately clog the wellbore. In such cases, expensive "cleanout" operations, which involve down time in well production, must be undertaken.

A need, therefore, has existed for provision of an efficient means for preventing or inhibiting, or method of operation for preventing or inhibiting, significant or extended deposition of particles in wellbores, particularly during drilling, more particularly in the drilling of deviated wellbores, and most especially in the drilling of deviated wellbores with coiled tubing. A need has further existed, in the event deposition of particulate matter does occur, for providing an effective "cleanout" means or method for elimination or reduction of the wellbore deposits, whether in drilling operations or in subsequent production operations. The invention addresses these needs.

SUMMARY OF THE INVENTION

Accordingly, in one embodiment, the invention relates to a method of inhibiting deposition of particulate matter in a wellbore annulus while drilling a well, such as a well for the production of hydrocarbons, in which a wellbore or drilling fluid is provided to the bit, and a fluid mixture comprising wellbore or drilling fluid and particulate matter is returned through the wellbore annulus to the earth surface, the wellbore or drilling fluid comprising an effective amount of translocating fibers and/or platelets and being provided at a flow rate sufficient to maintain particulate matter and translocating fibers and/or platelets in suspension in the wellbore annulus. According to the invention, in one further aspect of this embodiment, translocating fibers and/or platelets, and particulate matter, are removed from the fluid mixture, while in another approach, particulate matter is removed and fibers and/or platelets containing fluid may be recovered or returned for use. In a further embodiment, the invention relates to a method in which a deposit of particles or particulate matter in a wellbore is contacted with a fluid containing translocating fibers and/or platelets at a rate sufficient to remove and suspend particles from the deposit in the fluid. As utilized herein, the phrase "particulate matter" and the term "particles" are considered generally synonymous, and refer to discrete solids, such as drillbit cuttings, proppant fragments, or other particles occurring in wellbores. Again, as used herein, the term "translocating", with reference to the fibers and/or platelets employed, refers to the capability of the fibers and/or platelets to assist fluid transfer of particulate matter in the fluid, as well as, in conjunction with wellbore fluid, initiate movement of such particulate matter in the fluid from a deposit in the wellbore. Translocating fibers and/or platelets, therefore, will be of sufficient size and stiffness as to exert a mechanical force individually or in aggregation as a network on particles in the wellbore fluid or in deposits thereof such that the particulate matter is assisted or maintained in suspension in the fluid or its suspension therein is promoted. In a further embodiment, the invention relates to a method of drilling a well, preferably a well for the production of hydrocarbons, in which a wellbore is drilled with a drill bit while supplying or providing a suitable wellbore or drilling fluid to the bit, the fluid comprising or containing an effective amount of translocating fibers. The drilling operation produces or forms a fluid mixture comprising the wellbore or drilling fluid, particulate matter (or cuttings), and the translocating fibers, in the wellbore. In the usual case, the wellbore fluid mixture is circulated out of the wellbore and the particulate material and fibers are subsequently removed from the fluid mixture, leaving a fluid which may be reused. Optionally, and depending, inter alia, on the translocating fibers employed, the particulate material may be removed, and the fibers and fluid may be reused. In yet a further embodiment, the invention relates to a method or process in which a wellbore or cleanout fluid, such as a drilling fluid or a well treatment fluid, and containing translocating fibers, is provided to or circulated in a wellbore containing deposited particulate matter. After contacting the deposit, the wellbore fluid containing particulate matter removed from the deposit is returned to the surface. Particulate material and fibers may be removed from this wellbore fluid mixture, leaving a wellbore fluid which may be recovered or reused, or particulate matter may be removed, leaving a fibers-containing fluid which may be recovered or reused. In additional embodiments, translocating platelets may be used instead of fibers, and mixtures of translocating fibers and platelets may also be used. As will be apparent, the invention is particularly and uniquely adapted to the drilling of and cleanout of deviated wells, especially those such operations in which coiled tubing is employed. While there is no desire to be bound by any theory of invention, evidence suggests, as indicated, that the presence of an appropriate quantity of fibers, and/or platelets, of the type described, in a circulating fluid, aids transport of particles. Additionally, evidence also suggests that during circulation of the described fibers-containing fluid over or in contact with deposits of particulate material, the fibers promote or assist in removal or detachment and transport of particles from the deposits and in maintaining particles in the fluid. The intent of the invention, therefore, is to utilize the fibers and/or platelets in active wellbore operations such as drilling and wellbore cleanout, the fibers and/or platelets being maintained in suspension in the wellbore annulus and generally without significant aggregation during use. In each instance, as employed herein, the phrase "and/or" is used to indicate that the terms or expressions joined thereby are to be taken together or individually, thus providing three alternatives enumerated or specified.

DETAILED DESCRIPTION OF THE INVENTION

Figure 1:
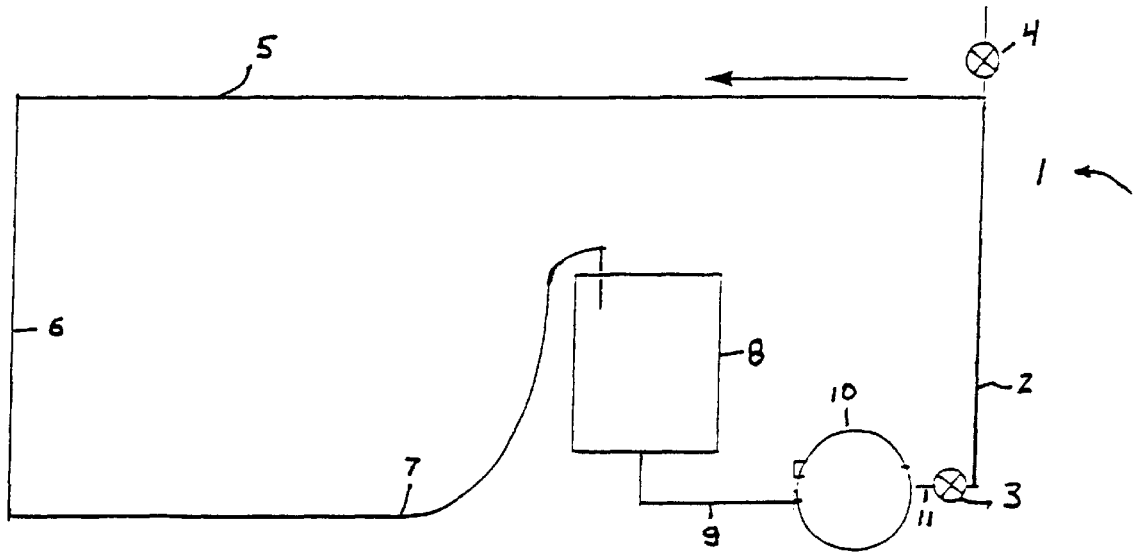
FIG. 1 illustrates schematically a test loop for evaluating fiber transport capability.

The nature of the operation being conducted will determine the choice of fluid employed with the fibers or platelets, or fibers and platelets component of the invention, and the particular wellbore fluid chosen per se forms no part of the present invention. For example, any suitable wellbore fluid, such as a drilling fluid or mud, or cleanout fluid, as the operation may require, which is adapted to or which provides sufficient viscosity to transport the fibers and/or platelets of the invention and particles in or from the wellbore may be used, it being recognized that the term "fluid", with respect to a liquid employed, may include mixtures and a variety of components. As those skilled in the art will appreciate, however, the particular fluid, translocating fibers and/or platelets, and any other components must be compatible or generally inert with respect to each other. As understood herein, the components of the fluid are taken to be "inert" if they do not react with one another, degrade, or dissolve, faster than a desired or considered rate, or otherwise individually or in combination deleteriously interfere to any significant extent with the designed functions of any component, thus permitting the use, as described hereinafter, of fibers, platelets, or other components in the fluid which may react, degrade, or dissolve over time. Given these considerations, the particular wellbore fluid chosen will be determined by such factors as the task to be performed, the treating temperature, and amount and nature of the solid particulate material to be transported or removed. The fluid may be aqueous or non-aqueous as the case may require, and may comprise a gas or gases, i.e., fiber or platelets-containing foams may be employed, and the fluids may also include usual viscosifying agents and components to aid in particle transport. In general, any drilling, drill-in, or well treatment fluid commonly used may be employed in the invention, keeping the requirements previously mentioned in mind, preferred fluids comprising water-in-oil or oil-in-water emulsions. Particularly preferred fluids include cellulose-based fluids, hydroxycellulose-based fluids, viscoelastic surfactant based fluids, polyacrylamide-based fluids, and guar-based fluids. Carbon dioxide and nitrogen are preferred foaming gases.

Proportions of the components of the fluid suspension, including those of the fibers and/or platelets, will be selected to insure that fluid character, i.e., flowability, and suspension or dispersion of the translocating fibers and/or platelets are maintained during pumping or down well transport, and during "upwell" movement of the suspension of fluid, fibers, and transported particulate matter. That is, an amount of the wellbore or well treatment fluid or liquid is provided or present which is sufficient to insure fluidity or fluid flow characteristics for all the material, e.g., particles or cuttings and/or matter from a deposit, to be transported. Normally, the composite fluids or fluid suspensions of the invention supplied to the wellbore will comprise moderately viscous liquids. In conjunction with the amount of fluid utilized, the fibers and/or platelets will be present in the fluid in a concentration effective to achieve the desired purpose, i.e., maintain suspension or prevent deposition of particulate matter, and/or remove deposits. Preferably, the fibers and/or platelets level, i.e., concentration, used in the fluid may range from 0.01 percent up to about 10 percent by weight of the fluid, depending on the nature of the fibers. For example, metal fibers will normally be provided at a higher weight basis than polyester fibers. Most preferably, however, the fibers and/or platelets concentration ranges from about 0.1 percent to about 5.0 percent by weight of fluid. Unless otherwise specified or evident from the context, all percentages given herein are by weight, based on the weight of the fluid.

The fibers employed according to the invention may have a wide range of dimensions and properties. As employed herein, the term "fibers" refers to bodies or masses, such as filaments, of natural or synthetic material(s) having one dimension significantly longer than the other two, which are at least similar in size, and further includes mixtures of such materials having multiple sizes and types. As indicated previously, the translocating fibers employed will be of sufficient size and stiffness such that particulate matter is assisted or maintained in suspension in the fluid or its suspension therein is promoted. Accordingly, for effectiveness in the matter transport and deposit reduction aspects of the invention, fibers employed will have at least one dimension significantly greater than the particles involved, and will possess a certain stiffness, as described more fully hereinafter, and will normally have a minimum bending radius which is no less than a single particle diameter. Preferably, in accordance with the invention, individual fiber lengths may range upwardly from about 1 millimeter. Practical limitations of handling, mixing, and pumping equipment in wellbore applications currently limit the practical use length of the fibers to about 100 millimeters. Accordingly, a preferred range of fiber length will be from about 1 mm to about 100 mm or so, with a most preferred length being from at least about 2 mm up to about 30 mm. Similarly, fiber diameters will preferably range upwardly from about 5 microns, a preferred range being from about 5 microns to about 40 microns, most preferably from about 8 microns to about 20 microns, depending on the modulus of the fiber, as described more fully hereinafter. A ratio of length to diameter (assuming the cross section of the fiber to be circular) in excess of 50 is preferred. However, the fibers may have a variety of shapes ranging from simple round or oval cross-sectional areas to more complex shapes such as trilobe, figure eight, star-shape, rectangular cross-sectional, or the like. Preferably, generally straight fibers with round or oval cross sections will be used. Curved, crimped, branched, spiral-shaped, hollow, fibrillated, and other three dimensional fiber geometries may be used. Again, the fibers may be hooked on one or both ends. Fiber and platelet densities are not critical, and will preferably range from below 1 to 4 $g/cm^3$ or more.

In addition to fiber dimension, in determining a choice of fibers for a particular operation, while consideration must be given to all fiber properties, a key consideration, as indicated, will be fiber stiffness. Thus, fibers will be selected that have sufficient stiffness to promote or assist in transport of particles and especially the removal and transport of particles from a deposit in a wellbore. In general, however, as those skilled in the art will appreciate, the stiffness of fibers is related to their size and modulus, and must be considered in accordance with the particles to be removed and transported. With this relationship in mind, fibers with tensile modulus of about 2 GPa (gigapascals) or greater, measured at 25° C., are preferred, most preferably those having tensile moduli of from at least about 6 GPa to about 1000 GPa, measured at 25° C. However, organic polymers other than aramides, such as nylon, usually have lower modulus, and thicker, i.e., larger diameter fibers, will be required. The suitability of particular fibers for the particular case, in terms of transport ability or particle removal ability, will be determined by appropriate testing, as described more fully hereinafter.

Those skilled in the art will recognize that a dividing line between what constitute "platelets", on one hand, and "fibers", on the other, tends to be arbitrary, with platelets being distinguished practically from fibers by having two dimensions of comparable size both of which are significantly larger than the third dimension, fibers, as indicated, generally having one dimension significantly larger than the other two, which are similar in size. As used herein, the terms "platelet" or "platelets" are employed in their ordinary sense, suggesting flatness or extension in two particular dimensions, rather than in one dimension, and also is understood to include mixtures of both differing types and sizes. In general, shavings, discs, wafers, films, and strips of the polymeric material(s) may be used. Conventionally, the term "aspect ratio" is understood to be the ratio of one dimension, especially a dimension of a surface, to another dimension. As used herein, the phrase is taken to indicate the ratio of the diameter of the surface area of the largest side of a segment of material, treating or assuming such segment surface area to be circular, to the thickness of the material (on average). Accordingly, the platelets utilized in the invention will possess an average aspect ratio of from about 10 to about 10,000, preferably 100 to 1000. Preferably, the platelets will be larger than 5 microns in the shortest dimension, the dimensions of a platelet which may be used in the invention being, for example, 5 $\mu$m.×2 mm.×15 $\mu$m. Stiffness or modulus requirements (GPa) would be analogous to those for fibers.

As indicated previously, the chemical nature of the materials from which the fibers or platelets are formed is not a key variable. Generally, the fibers and/or platelets should not react with the wellbore fluid or other components thereof or the particles to be removed and/or transported, and/or dissolve in the wellbore fluid, at a rate or rates such that the effect of the fibers and/or platelets in deposit reduction and/or transport of the particles to the surface is significantly reduced, or the deposit reduction and/or transport of the particles to the surface is otherwise significantly inhibited. This "inertness" and suitability of a particular fiber or platelet material may be determined by routine testing. Accordingly, the fibers and/or platelets employed in the invention may be chosen from a wide variety of materials, assuming the fibers and/or platelets meet the requirements described herein. Thus, natural and synthetic fibers and platelets, particularly synthetic organic fibers and platelets, and especially those that are biodegradable or composed of synthetic organic polymers or elastomers, as well as particular inorganic materials, or any type of fiber comprising mixtures of such materials, may be employed. For example, fibers or platelets composed of or derived from cellulose, keratin (e.g., wool), acrylic acid, aramides, glass, acrylonitrile, novoloids, polyamides, vinylidene, olefins, diolefins, polyester, polyurethane, vinyl alcohol, vinyl chloride, metals (e.g., steel), carbon, silica, and alumina, may be used. Preferred fiber types include rayon, acetate, triacetate, (cellulose group); nylon (polyamide), Nomex® and Kevlar® (polyaramides), acrylic, modacrylic, nitrile, polyester, saran (polyvinylidene chloride), spandex (polyurethane), vinyon (polyvinyl chloride), olefin, vinyl, halogenated olefin (e.g., Teflon®, polytetrafluoroethylene) (synthetic polymer group); azlon (regenerated, naturally occurring protein), and rubber (protein and rubber group). Fibers and platelets from synthetic organic polymers, including, as indicated, mixtures of the polymeric materials, are preferred for their ready availability, their relative chemical stability, and their low cost. Polyester fibers, such as Dacron® fibers, and polyolefins, such as polyethylene and polypropylene, are most preferred. Again, composite fibers, comprising natural and/or synthetic materials, may be employed. For example, a suitable composite fiber might comprise a core and sheath structure where the sheath material provides necessary stiffness, but degrades over a desired period of time, the core comprising a soft and water soluble material.

The fibers, or fibers and/or platelet-containing fluids used in the invention may be prepared in any suitable manner. The fibers and/or platelets may be blended offsite, or, preferably, the fibers and/or platelets are mixed with the fluid at the job site, preferably on the fly. In the case of some fibers, such as novoloid or glass fibers, the fibers should be "wetted" with a suitable fluid, such as water or a wellbore fluid, before or during mixing with the drilling or wellbore fluid, to allow better feeding of the fibers. Good mixing techniques should be employed to avoid "clumping" of the fibers and/or platelets.

The amount of fibers and/or platelets-containing fluid supplied will be sufficient for the task required, i.e., an amount effective under the conditions, such as wellbore annulus conditions, and in conjunction with the flow rate, to maintain suspension of or to prevent deposition of particles, and/or to remove and suspend them, in the wellbore annulus, as the case may be. In drilling operations, for example, fibers usage may be continuous to maintain suspension of or to prevent deposition, but preferably will be on a non-continuous basis, "slugs" of fibers being added to the drilling fluid on a regular or irregular basis to maintain a relatively deposit-free wellbore. Again, a well might be drilled to completion, or substantially so, with the fibers and/or platelets containing fluid of the invention being provided or supplied at total depth to provide good wellbore annulus flow. In other operations, such as cleanout operations, the fibers and/or platelets-containing fluid may be provided through suitable injection means until the desired deposit removal is obtained. In most instances, as indicated, it will be preferred to pump the suspension of fibers and/or platelets only during a portion of a job, e.g., perhaps for 10–25% of the job to control particle deposits.

According to the invention, the provision of or flow rate of the translocating fibers and/or platelets-containing fluid to the particle deposit and therefrom is at a rate at least sufficient to inhibit settling of the particles transported or maintain their suspension in the wellbore annulus. While the size of the particles will vary greatly, depending somewhat on their origin, commonly ranging from finer than 200 mesh up to one-half inch and greater in length, normal drilling fluid pumping rates, with the presence of the translocating fibers and/or platelets in the concentrations indicated, will generally be sufficient to maintain suspension of particles and/or remove deposited particles. For example, pumping rates may range from 1 to 2 barrels per minute, and may be varied, as necessary, by those skilled in the art. In cleanout operations, similar rates may be employed.

In the usual case, the drilling fluid mixture or the wellbore fluid mixture will be processed at the surface to remove the particulate material or matter and/or fibers and leave fluids that may be reused, the particulate matter being sent to disposal. In such cases, the practice or equipment chosen for separation or removal is not a critical aspect of the invention, and any suitable separation procedure or equipment may be used. Standard equipment, such as screen shakers and settlers may be used, or, in some instances, agitation may be employed. In most instances, the fluid may then be returned to the pumps for reuse. In some cases, as indicated, fibers may be "removed" by alternative procedures or mechanisms, e.g., by degradation or dissolution of the fibers, in or out of the wellbore. For example, a composite fiber type may be employed in which some or all of the fibers comprise a continuous phase and a discontinuous "droplet-like" phase, the later phase being slowly soluble in the wellbore fluid to allow a timed break-up of these fibers. Preferably, a wellbore procedure utilizing fiber dissolution or degradation will be employed only on a periodic basis to avoid substantial buildup of dissolved or by-product material in the drilling or wellbore fluid.

A.

In order to determine the effect of a fibers-containing fluid on deposited particulate matter, experiments were conducted in a horizontal slot flow cell. The flow cell utilized provides rectangular slot flow, is similar to that described by Kern et al, *Trans. AIME* (1959), 216, 403–405, and is constructed of transparent plexiglass. The external dimensions of the cell were such as to provide a flow path which has a horizontal length of 72 inches, a height of 6 inches, and a width of ¼ inch. Fluid was circulated through the cell by a circulation system which included a mixing tank with mixer, a pump, and appropriate valving and circulation lines, all connected to provide continuous fluid flow to the inlet and from the outlet of the cell.

I.

A test mixture comprising 22 liters of fluid (water) and 2 pounds of particulate material, in this case, 20/40 bauxite, was loaded in the mixing tank. The water and particles were stirred continuously in the tank, and the mixture was circulated through the flow cell and back to the mixing tank at a rate of about 0.83 liters per second. Within one minute from the start of circulation of the mixture, a bed of bauxite particles was deposited on the bottom of the flow cell, the height (depth) of which, at a point about 31.5 inches from the entry of the cell, was approximately 4 inches. The bed continued to increase in height at this location until it reached an equilibrium height, which was about four to four and one-half inches. The average fluid velocity of the fluid-bauxite mixture in the cell above the bed at equilibrium was about 3.0 meters per second. After equilibrium was reached, four separate 55 gram quantities of polyester fibers (Dacron® Type 205NSO), manufactured by and available from E. I. duPont de Nemours and Company, were added to the mixing tank and allowed to circulate through the cell. Dacron® Type 205NSO is a polyester staple fiber chopped to 6 millimeters in length, is 1.5 denier (approximately 12 $\mu$m) and is coated with a water dispersible sizing agent. Each increment of fibers produced a rapid erosion of the bed. Upon completion of the addition of the full 220 grams of Dacron® fibers, the particle bed had eroded at the measurement location to a height of less than 2 inches. The particles removed from the bed by the fiber addition remained suspended in the flowing fluid mixture.

II.

The general procedure of experiment I was repeated, except that 20/40 Brady sand was substituted for the bauxite particles. Upon addition of the Dacron® fibers, as described, the bed of sand particles at the bottom of the flow cell eroded to a maximum height of about 2 inches at the measurement point. The average fluid velocity of the fluid fiber-sand mixture above the bed at equilibrium was about 0.8±0.3 meters per second. In both experiments, fibers in the fluid mixture flowing through the cell appeared, by visual inspection, to be dragging in or along the particle bed deposit and promoting movement of the particles into the mixture.

B.

In the past, fibrous materials have been employed in lost circulation and fracturing procedures with the intent of depositing the materials in a formation opening or fracture to stem circulation losses or leakoff and form packs with proppant. To determine if fibers movement and circulation might be consistently maintained in a circulating fluid in a wellbore, particularly if particulate material was also in circulation, and without clogging of openings in equipment or creation of a blocking mat, the following experiments were conducted.

III.

To simulate behavior of a circulating fluid mixture containing fibers, and that of a mixture of fluid, fibers, and particulate material, in a wellbore or wellbore equipment, a circulation system provided with an element having restricted openings, such as might be found in drillbits, etc., in a wellbore, was constructed. The principal components of the system were a vertically disposed manifold having restricted exit apertures, a mixing tank, a pump and lines for conveying fluid mixtures from the mixing tank to the manifold, and return lines from the exit apertures of the manifold to the mixing tank. The manifold comprised an upright section of 2 inch ID pipe approximately 3 feet in length with eight ¼ inch NPT tapped apertures or holes spaced at three inch intervals on a 60° phasing. The tapped holes were fitted with nipples, and the nipples were joined to sections of ⅜ inch clear tygon tubing which served as the return lines to convey fluid leaving the apertures to the mixing tank.

Seven tests or runs were conducted. In each run, 20 liters of water containing 0.03 of guar per gallon was blended, after thorough hydration of the guar, with 200 gram quantities of Dacron® Type 205NSO (described previously) in the mixing tank until the predetermined maximum fiber concentration for each test was obtained. Once the desired fiber concentration was obtained for each run, the fluid mixture was pumped through the manifold and back for five minutes to determine if blockage of the openings in the manifold by the fibers alone would occur. Following this step, 20/40 bauxite particles were added in each case in 4.79 kg increments. After each addition, the fluid mixture was allowed to circulate to determine if blockage occurred. The addition of particulate matter continued until the maximum predetermined concentration was reached, or the system screened out. The total time for each of the tests ranged from 18 through 35 minutes. In no instance did a fluid containing only fibers block the openings. Blockage did occur in a number of runs because of deposit of the bauxite particles in the dead zone at the bottom of the vertical manifold, it being evident that the deposit grew upward from the bottom of the manifold. In only one test involving significant fiber and particles concentration did genuine blockage occur. It is evident, therefore, that fibers of appropriate dimensions may be freely circulated through standard equipment.

IV.

Further according to the invention, there is shown in FIG. 1 a schematic representation of a flow loop designated generally as 1. For simplicity, all connections and extraneous equipment, such as clamps and supports, have not been illustrated. Flow loop 1 includes a first vertical tubular loading section 2, approximately three feet in height, which is terminated at one end by valve 3 and at the other end by a capped port 4 which is suitable for introduction of particulate matter. Section 2 also communicates through a suitable connection with a first horizontal flow section 5. First horizontal flow section 5 comprises a straight tubular flow section 20 feet in length, and in turn is connected to and communicates with vertical tubular flow section 6, which is approximately 4 feet in length. Vertical flow section 6 is connected to and communicates with flow section 7 which is positioned horizontally and has an irregular or wavy path over the major portion of its length. Sections 2, 5 and 6 are constructed of rigid 1 inch internal diameter plexiglass, while section 7 is made of 1 inch internal diameter clear plastic hose. Section 7 also is approximately 20 feet in length, and communicates with and discharges into fluid control tank 8 as shown. Fluid control tank 8 communicates via line 9 to the intake of pump 10, in this instance a Warren Rupp SBI-A Type 4 air powered double diaphragm pump. The discharge of pump 10 communicates with and is connected to line 11, which in turn communicates with and is connected to valve 3, thus providing a complete fluid flow loop.

In each experiment, the flow loop 1, including the control tank 8, was first filled with the fluid to be tested. A flow rate for the fluid was then selected. Flow rates were determined in the experiments by measuring the time for a given amount of fluid to be pumped into a 4000 ml. graduated cylinder. This approach was employed because the presence of fibers in a number of the test fluids made the use of flow meters impractical.

In each case, the system was filled with fluid, except that portion of the vertical section 2 above the connection with first horizontal section 5 in order to allow for introduction of particulate matter. After fluid introduction, a measured quantity of particulate material, in this case, 300 grams of 30/60 bauxite particles, was added through port 4 into vertical section 2, valve 3 remaining closed. In the case of fluids containing fibers, several minutes were required for the particles to settle, and agitation of tube 2 was used to promote settling.

Pump 10 was then started, and valve 3 was opened so that particles and liquid in section 2 began flowing into first horizontal flow section 5. As soon as particles entered section 5, timing of particle movement was begun. While particles entering section 5 were in suspension, once in the horizontal section the particles tended to disperse, spread out, and form distinct transport patterns. For example, at sufficiently high flow rates, the transport pattern might comprise primarily suspended flow, perhaps over a moving bed of particles. At lower flow rates, stationary beds or sliding "dunes" might represent the dominant pattern. In each experiment the total time for all of the particles to traverse first horizontal flow section 5, vertical section 6, and flow section 7, and arrive in tank 8 was recorded. Determination of completion of the flow loop by the particles was made by visual observation. In most cases, this determination corresponded to observation of a trailing edge of particles of a very pronounced "dune".

In the tests, four different fluid systems were evaluated in their ability to transport the bauxite particles. The four fluid systems were:

A. Water

B. Water+1% Dacron® Type 205NSO fiber, ¼ inch in length, 12 $\mu$m in diameter.

C. Linear guar gel. (water base) (10 lbs guar/1000 gal.)

D. Linear guar gel. (water base) (10 lbs guar/1000 gal.)+1% Dacron® Type 205NSO fiber, ¼ inch in length, 12 $\mu$m in diameter.

Figure 2:
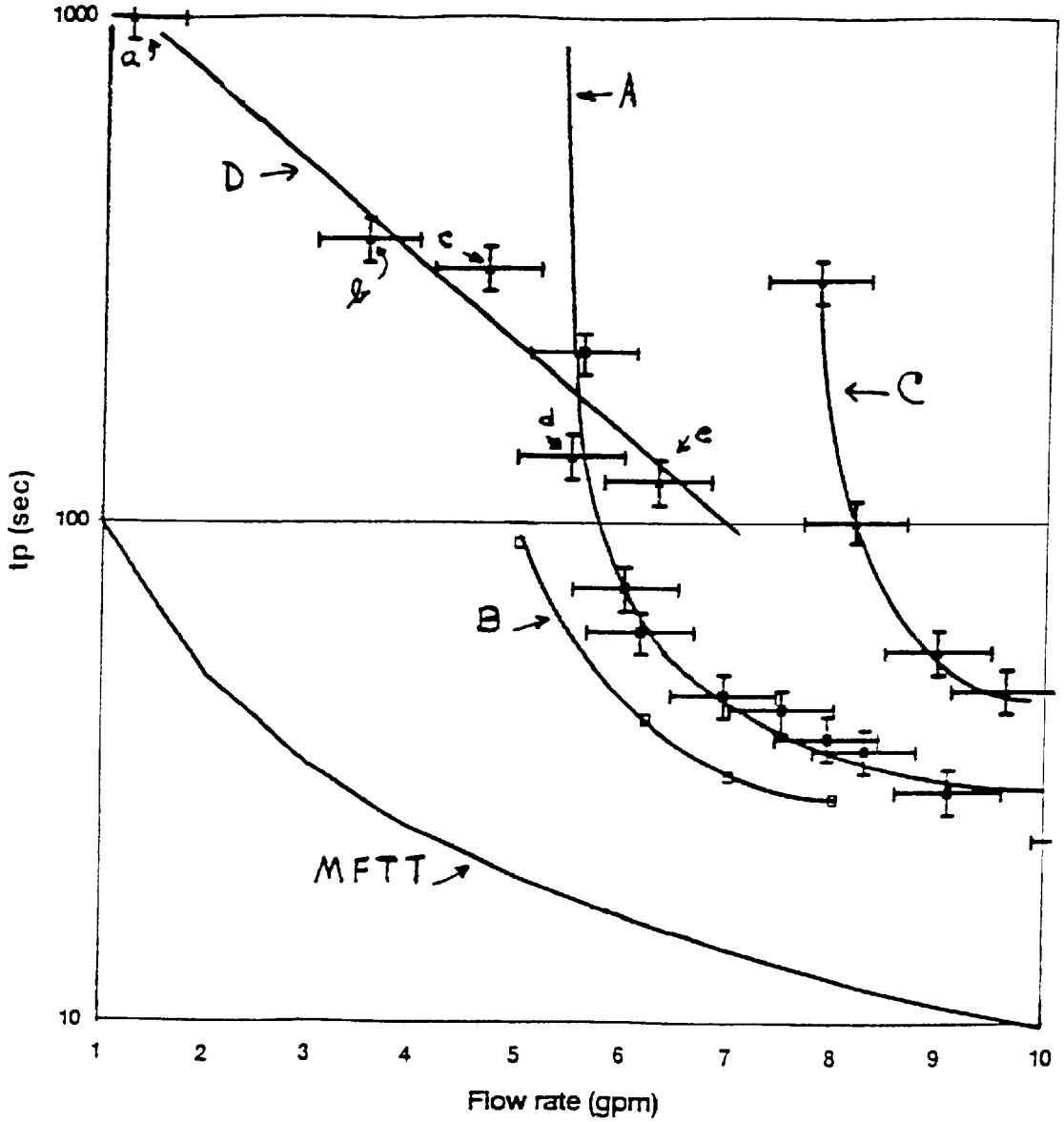
FIG. 2 is a graph illustrating results of experiments carried out in the test loop of FIG. 1.

Results of the tests are described as follows, and are illustrated particularly in FIG. 2. In FIG. 2, the measured time ($t_p$) for sweeping solid particles through the flow loop, as described, is plotted as a function of flow rate for the fluid systems mentioned. Additionally, line MFTT represents a calculation of the time for an imaginary piece of fluid to traverse the flow loop based on the mean fluid velocity.

Water (Fluid System A)

Ordinary tap water was tested to provide a baseline or control for comparison with linear gel and fiber containing fluids. For the water tests, all the test conditions shown in FIG. 2 are in turbulent flow with $Re_D$ ranging from 20400 at 6 gpm to over 35000 at 10.4 gpm. As indicated by curve A, effective transport of bauxite particles through the flow loop was not achieved until the flow rate exceeded approximately 5 gpm. Below this flow rate, the particles entered the horizontal section of the pipe, but deposited on the bottom of the pipe within the first twelve feet. The result was a long, dispersed stationary bed with clear fluid moving over it. Neither turbulence nor drag forces were sufficient to resuspend the particles, and a steady state condition was reached with no effective particle transport. For flow rates above 5 gpm, however, particle transport through the loop was measurable. After entering the horizontal sections of the loop, the particles moved in a sliding bed with a distinct dune pattern. For flow rates up to 8 gpm, this dune pattern was visibly very crisp with a clear demarcation between the top of the dune and the clear fluid moving above it. Drag forces between the fluid and the uppermost layer of particles kept the dune moving forward. Although particle transport was occurring, FIG. 2 shows that the time for all the particles to traverse the loop is substantially slower than the mean time for the water traveling in the loop (MFTT curve). At a flow rate of 7 gpm, for example, the mean time for water to traverse the loop would be 14 seconds, whereas the last of the particles required 45 seconds.

Water+1% Dacron® Type 205NSO Fiber (Fluid System B)

In the case of water plus the specified fiber, four measurements were made at flow rates ranging from 5 to 8 gpm, and results are shown on curve B. In each case, the addition of the fibers accelerated the cleanout process and reduced the total fluid volume required. At 7 gpm, for example, all of the solid particles were swept out within 30 seconds for the water-fiber mixture, compared to 45 seconds for water alone. This represents a 33% decrease in the total quantity of fluid used to clean the flow loop. Perhaps more importantly, the fiber-water mixture was able to clean the flow loop at flow rates lower than those for which water alone was able to move particles efficiently. The fiber-water slurry cleaned the flow loop in under 100 seconds with a 5 gpm flow rate. With water alone, this same flow condition represented the lower limit at which successful particle movement takes place, and cleanout of the loop required approximately ten times as much fluid.

Linear Guar Gel (Fluid System C)

For a linear guar gel mixed at 10 lb/1000 gal, FIG. 2 (Curve C) shows a substantial deterioration in cleanout performance compared to the water transport capabilities. The addition of the gel increased the viscosity of the fluid from approximately 1 cP to 6 cP (measured at 170 $s^{-1}$ on a Fann 35). The linear gel was unable to transport solids effectively for flow rates below approximately 7.5 gpm. Compared to water, linear gel at 9 gpm required almost twice the fluid volume to sweep the same amount of solid particulates through the flow loop. Assuming the six-fold increase in viscosity applied for the shear rates of the flow condition (wall shear rate was ~350 $s^{-1}$ at 9 gpm), $Re_D$ for the gel was approximately 5000, as compared to 31000 for water at the same flow rate.

Linear Guar Gel+1% Dacron® Type 205NSO Fiber (Fluid System D)

The final set of measurements shown in FIG. 2 are six measurements of the loop being cleaned with a mixture of 10# linear gel and 1% Dacron fiber. Five data points are labeled as a through e on Curve D. For condition a at 1.2 gpm, the flow was characterized by a large amount of the bauxite particles being moved initially in plug flow around the loop. Visually, it appeared as if the fiber-laden fluid was pushing a slug of particles through the tubes. This initial plug completed the loop in approximately 80 seconds, a transit time very close to the time required for the average fluid flow rate to traverse the flow loop. Particles which separated from this initial slug, however, formed a very long (>3 ft) dune in the first horizontal section and slowly progressed as saltation over a stationary bed. After 20 minutes all the solid particles had traversed both horizontal lengths of the flow loop, a small amount of the particles had become "trapped" in the bend near the discharge, and the test was stopped.

More rapid solids transport was observed at test points b and c, which were measured with linear gels and fibers at flow rates of 3.5 and 4.7 gpm, respectively. Both measurements resulted in steady particle dune movement through the flow loop. Although there was no stalling in the final bend as experienced in run a, it is notable that the dune in test b spent as much time climbing the bend as it did in traversing the entire rest of the flow loop.

In all the runs containing fibers, it was observed that fibers eroded particle dunes as well as moving them through the tubes. With a sufficient volume of flow over a dune, the entire dune can be entrained in a fiber network, at which point all the solids are transported at nearly the mean velocity of the fluid. This was observed to occur at a test condition e) where a fiber slurry flowing at approximately 6.3 gpm produced a 2 ft long, very shallow dune in the first horizontal section of the flow loop. The dune was completely eroded before the end of the 20 ft length, and visually appeared to "evaporate" into the flow field after about 2 minutes of the total pump time.

Figure 3:
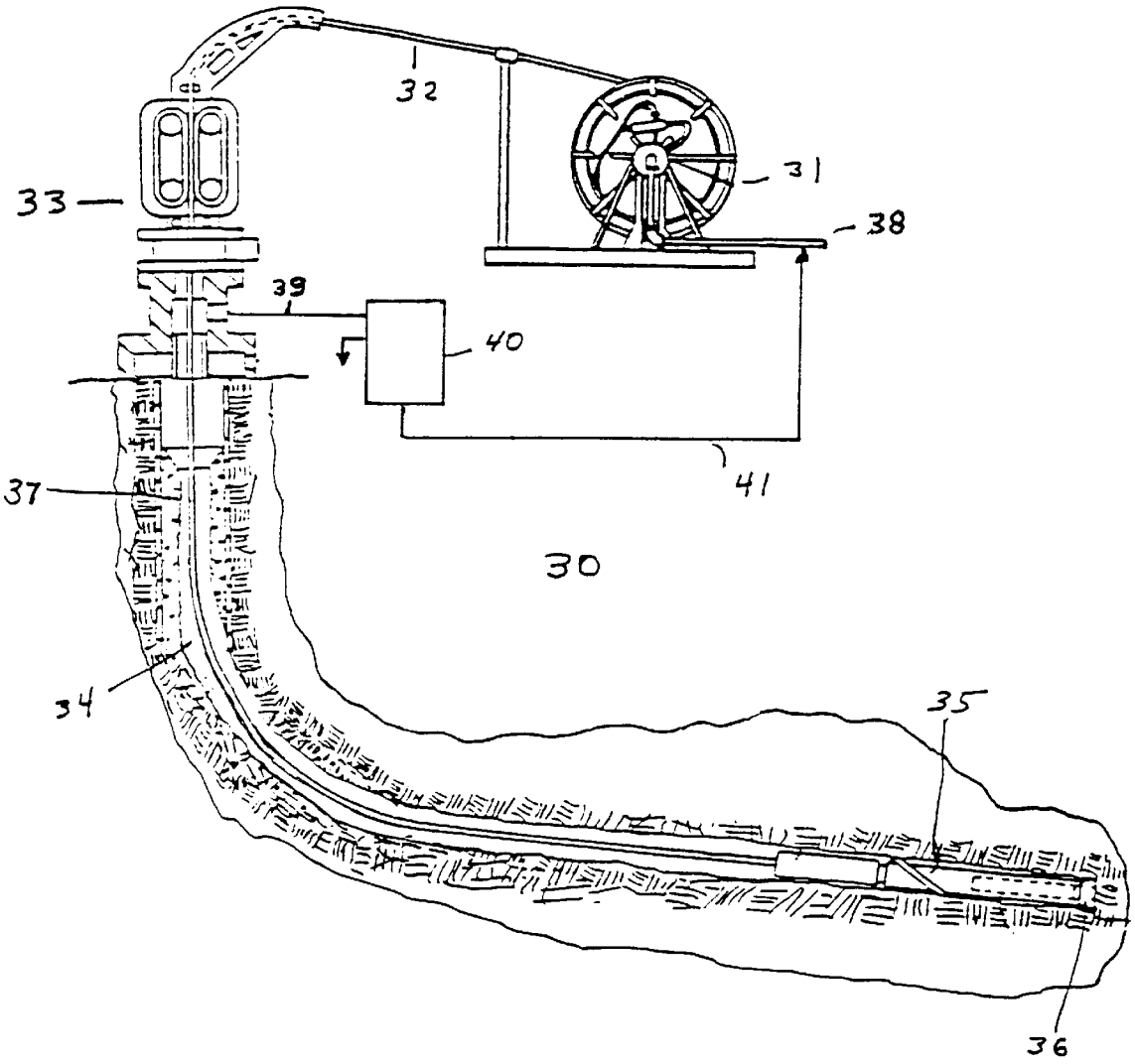
FIGS. 3 and 4 together illustrate schematically a preferred embodiment in which a fibers-containing fluid is employed to remove particulate matter while drilling with a coiled tubing system in a deviated wellbore. The effect illustrated in FIG. 4 is applicable to that aspect of the invention wherein a fluid containing fibers is utilized to remove particulate matter in operations other than drilling, such as in cleanout operations.
Figure 4:
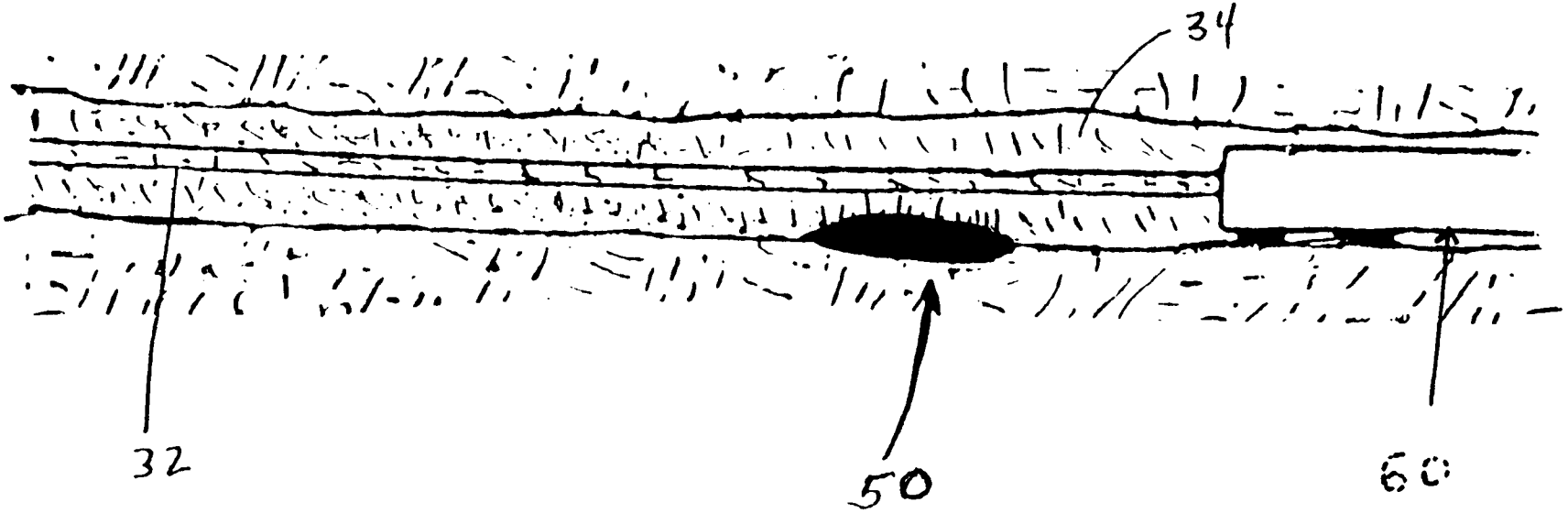

FIGS. 3 and 4 of the drawing illustrate schematically a preferred application of the invention in drilling with coiled tubing. Without denominating all elements shown, the rig and string, indicated generally as 30 in FIG. 3, includes a conventional coiled tubing reel 31 which supplies a coiled tubing string 32 through standard tubing injection and wellhead equipment 33 into wellbore 34, the tubing connecting with and communicating with downhole drilling unit 35 and bit 36. Wellbore 34 has been drilled in a manner known to those skilled in the art, such as by drilling an initial vertical section 37 by a standard drilling rig, and then "stepping out" with appropriate equipment, such as a unit 35, which may include a "mud motor" for operation of the bit 36 to lengthen the borehole. As is well known and practiced, drilling fluid or mud is supplied to and through the bit 36 through the coil tubing via entry line 38. Particulate matter and fluid are returned via the annulus around the coiled tubing in wellbore 34 and are removed at the surface through line 39. The fluid and particulates in line 39 are then sent to separation equipment, such as shale shakers 40, where fluid and particles are separated. Drilling fluid is returned for reuse via line 41, while particulate matter is sent to disposal. FIG. 4 represents an enlargement of a section of borehole in which a deposit 50 of particulate matter (particles) has previously developed. In accordance with the invention, fibers, such as polyester fibers, for example, Dacron® Type 205NSO fibers, are added to the mud at 38 in an amount to provide a concentration of about 1.0 weight percent. The fibers-containing fluid is then sent downhole through coiled tubing 32 at normal circulation rate. The fibers-containing fluid exits bit 36, returning through the annulus of wellbore 34. As the fibers containing fluid contacts the collected particles 50, particles are swept from the deposit, assisting in maintaining good flow of drilling mud in the wellbore. The fluid containing removed particles and fibers are sent via line 39 to separation device 40, where, preferably, at least the bulk of the fibers and particles are separated from the mud, and the fluid separated may be recirculated in normal fashion via line 41. In the case of a cleanout operation, drilling elements 35 and 36 would be replaced by suitable injection equipment 60 (dotted).

What is claimed is:

1. A method of removing particulate matter from a deposit in a wellbore during cleanout operations of the wellbore, said method comprising contacting a deposit of particulate material in a wellbore with a wellbore fluid, in an amount and at a rate sufficient to remove particulate matter from the deposit, the wellbore fluid comprising an effective amount of translocating fibers and/or platelets selected from fibers and/or platelets, respectively of aramides, glass, metals, carbon, silica, and alumina.

2. The method of claim 1 in which wellbore fluid, after contacting the deposit, is returned to the earth surface with particulate matter removed from the deposit.

3. The method of claim 2 in which translocating fibers and/or platelets and particulate matter are removed from the wellbore fluid.

4. The method of claim 3 in which an effective amount of inert translocating fibers and/or platelets is employed.

5. The method of claim 4 in which individual fiber lengths are at least about 1 millimeter, with fiber diameters being at least about 5 microns, the fibers are selected from fibers having a tensile modulus of at least 2 GPa, measured at 25° C., and the fibers are present in a concentration of from 0.01 percent to about 10 percent by weight, based on the weight of the fluid.

6. The method of claim 4 in which individual fiber lengths are at least about 2 millimeters, with fiber diameters being at least about 5 microns, the fibers are selected from fibers having a tensile modulus of at least 6 GPa, measured at 25° C., and the fibers are present in a concentration of from 0.1 percent to about 5 percent by weight, based on the weight of the fluid.

7. The method of claim 2 in which particulate matter is removed from the wellbore fluid.

8. The method of claim 7 in which an effective amount of inert translocating fibers and/or platelets is employed.

9. The method of claim 8 in which individual fiber lengths are at least about 1 millimeter, with fiber diameters being at least about 5 microns, the fibers are selected from fibers having a tensile modulus of at least 2 GPa, measured at 25° C., and the fibers are present in a concentration of from 0.01 percent to about 10 percent by weight, based on the weight of the fluid.

10. The method of claim 8 in which individual fiber lengths are at least about 2 millimeters, with fiber diameters being at least about 5 microns, the fibers are selected from fibers having a tensile modulus of at least 6 GPa, measured at 25° C., and the fibers are present in a concentration of from 0.1 percent to about 5 percent by weight, based on the weight of the fluid.

11. A method comprising contacting a deposit of particulate material in a wellbore with a wellbore fluid, in an amount and at a rate sufficient to remove particulate matter from the deposit, the wellbore fluid comprising an effective amount of translocating fibers and/or platelets, in which the translocating fibers are composite fibers.

12. The method of claim 11 in which the wellbore fluid, after contacting the deposit, is returned to the earth surface with particulate matter removed from the deposit.

13. The method of claim 12 in which the translocating fibers and/or platelets and particulate matter are removed from the wellbore fluid.

14. The method of claim 11 in which the individual fiber lengths are at least about 1 millimeter, with fiber diameters being at least about 5 microns, the fibers are selected from fibers having a tensile modulus of at least 2 GPa, measured at 25° C., and the fibers are present in a concentration of from 0.01 percent to about 10 percent by weight, based on the weight of the fluid.

15. A method comprising contacting a deposit of particulate material in a wellbore with a wellbore fluid, in an amount and at a rate sufficient to remove particulate matter from the deposit, the wellbore fluid comprising an effective amount of translocating fibers and/or platelets, in which the translocating fibers are mixtures of synthetic organic polymers.

16. The method of claim 5 in which the wellbore fluid, after contacting the deposit, is returned to the earth surface with particulate matter removed from the deposit.

17. The method of claim 16 in which the translocating fibers and/or platelets and particulate matter are removed from the wellbore fluid.

18. The method of claim 15 in which the individual fiber lengths are at least about 1 millimeter, with fiber diameters being at least about 5 microns, the fibers are selected from fibers having a tensile modulus of at least 2 GPa, measured at 25° C., and the fibers are present in a concentration of from 0.01 percent to about 10 percent by weight, based on the weight of the fluid.

* * * * *